US007004816B2

(12) United States Patent
Saitoh

(10) Patent No.: US 7,004,816 B2
(45) Date of Patent: Feb. 28, 2006

(54) GRINDING METHOD FOR VERTICAL TYPE OF DOUBLE DISK SURFACE GRINDING MACHINE

(75) Inventor: Akiyoshi Saitoh, Ikeda (JP)

(73) Assignee: Daisho Seiki Corporation, Osaka-fu (JP)

( * ) Notice: Subject to any disclaimer, the term of this patent is extended or adjusted under 35 U.S.C. 154(b) by 0 days.

(21) Appl. No.: 11/072,970

(22) Filed: Mar. 7, 2005

(65) Prior Publication Data

US 2005/0148286 A1 Jul. 7, 2005

(51) Int. Cl.
*B24B 49/00* (2006.01)

(52) U.S. Cl. ..... 451/10; 451/11; 451/41; 451/269

(58) Field of Classification Search ..... 451/5, 451/9, 10, 11, 41, 262, 268, 269, 285, 287
See application file for complete search history.

(56) References Cited

U.S. PATENT DOCUMENTS 3,653,854 A * 4/1972 Asano ..... 451/4
4,272,924 A * 6/1981 Masuko et al. ..... 451/1
4,433,510 A * 2/1984 Katagiri et al. ..... 451/5
5,136,817 A * 8/1992 Tabata et al. ..... 451/5
5,755,613 A * 5/1998 Uchida et al. ..... 451/41
5,989,108 A * 11/1999 Ikeda et al. ..... 451/268
6,074,275 A * 6/2000 Yashiki et al. ..... 451/5
6,454,635 B1 * 9/2002 Zhang et al. ..... 451/41
6,852,012 B1 * 2/2005 Vepa et al. ..... 451/41
6,932,685 B1 * 8/2005 Saitoh ..... 451/269

FOREIGN PATENT DOCUMENTS

JP 57021264 * 2/1982

* cited by examiner

*Primary Examiner*—Eileen P. Morgan
(74) *Attorney, Agent, or Firm*—Crowell & Moring LLP

(57) ABSTRACT

A grinding method for a vertical type of double disk surface grinding machine comprising a pair of rotating grinding wheels vertically opposed to each other and vertically movable and a moving table for moving a work having a work holding jig, wherein vertical positions of the upper and the lower surfaces of the work to be ground prior to the grinding operation are measured by means of a pre-grinding dimension measuring instrument disposed in a vicinity of the work attaching/detaching position and the standby positions of the grinding wheels are set based on the measured values in a step, the work is moved to the grinding position and the grinding wheels are moved at a high feeding speed from the set standby positions to grinding start positions in contact with the work or positions immediately before making the contact in a subsequent step, and the work is ground at a grinding speed lower than the feeding speed in a further subsequent step.

3 Claims, 4 Drawing Sheets

GRINDING METHOD FOR VERTICAL TYPE OF DOUBLE DISK SURFACE GRINDING MACHINE

This application is based upon application No. 2002-235684 filed and published in Japan. The data of publication of this application is Mar. 11, 2004.

BACKGROUND OF THE INVENTION

1. Technical Field of the Invention

The present invention relates to a grinding method employed in a vertical type of double disk surface grinding machine for simultaneously grinding an upper surface and a lower surface of a work to be ground which is held by a work holding jig by means of a pair of vertically movable upper and lower grinding wheels.

2. Prior Art

As an example of quantitative grinding implemented by the vertical type of double disk surface grinding machine, the Applicant of the present invention has developed a method in which a current value of a motor for rotating the grinding wheels is measured and grinding start positions of the grinding wheels are set in response to a variation of the current value. More specifically, the grinding wheels are made to approach the work while the current value of the motor for rotating the grinding wheels is being measured, and when an increase of the current value reaches a set value after the grinding wheels come into contact with the work, relevant positions are memorized in a controller or the like as the grinding start positions, and the upper and the lower grinding wheels are temporarily retreated to standby positions. Then, the two grinding wheels are fed again at a high speed to positions immediately before the grinding start positions after the grinding wheels detect the grinding start positions and retreat, and the speed is lowered to a grinding speed so that the grinding operation of a predetermined grinding allowance is implemented at the grinding start positions.

PROBLEMS OF THE INVENTION

When the upper and the lower surfaces of the work to be ground are ground according to the foregoing grinding method, the grinding start positions are detected without accurately knowing a pre-grinding precision of the work, that is vibratory movement, thickness, height and the like of the work before the grinding operation is implemented. Therefore, it is necessary to set the standby positions (retreating positions) of the grinding wheels to a position largely distant from the work in consideration of a variety of shapes of the work and the like, which unnecessarily increases a feeding amount (approach amount) of the grinding wheels and thereby causes a working efficiency to deteriorate.

OBJECTS OF THE INVENTION

A main object of the present invention is to provide a grinding method for a vertical type of double disk surface grinding machine capable of efficiently feeding grinding wheels in response to a pre-grinding precision of each work and grinding the work by measuring the work prior to the grinding operation despite a large variability present in the pre-grinding precision.

SUMMARY OF THE INVENTION

In order to solve the foregoing problem, according to an invention recited in claim 1 of the present application, a grinding method for a vertical type of double disk surface grinding machine comprising a pair of rotating grinding wheels vertically opposed to each other and vertically movable and a moving table for moving a work having a work holding jig wherein a position of the work can be changed by the moving table to and from a grinding position and a work attaching/detaching position, and at the grinding position, the both grinding wheels are moved from standby positions respectively vertically distant from upper and lower surfaces of the work to be ground to grinding end positions so that the upper and the lower surfaces of the work to be ground are simultaneously ground, is adapted in such manner that, in a step, vertical positions of the upper and the lower surfaces of the work to be ground prior to the grinding operation are measured by means of a pre-grinding dimension measuring instrument disposed in a vicinity of the work attaching/detaching position and the standby positions of the grinding wheels are set based on the measured values, in a subsequent step, the work is moved to the grinding position and the grinding wheels are moved at a high feeding speed from the set standby positions to grinding start positions in contact with the work or positions immediately before making the contact, and in a subsequent step the work is ground at a grinding speed lower than the feeding speed.

DETAILED DESCRIPTION OF THE PREFERRED EMBODIMENTS

Figure 1:
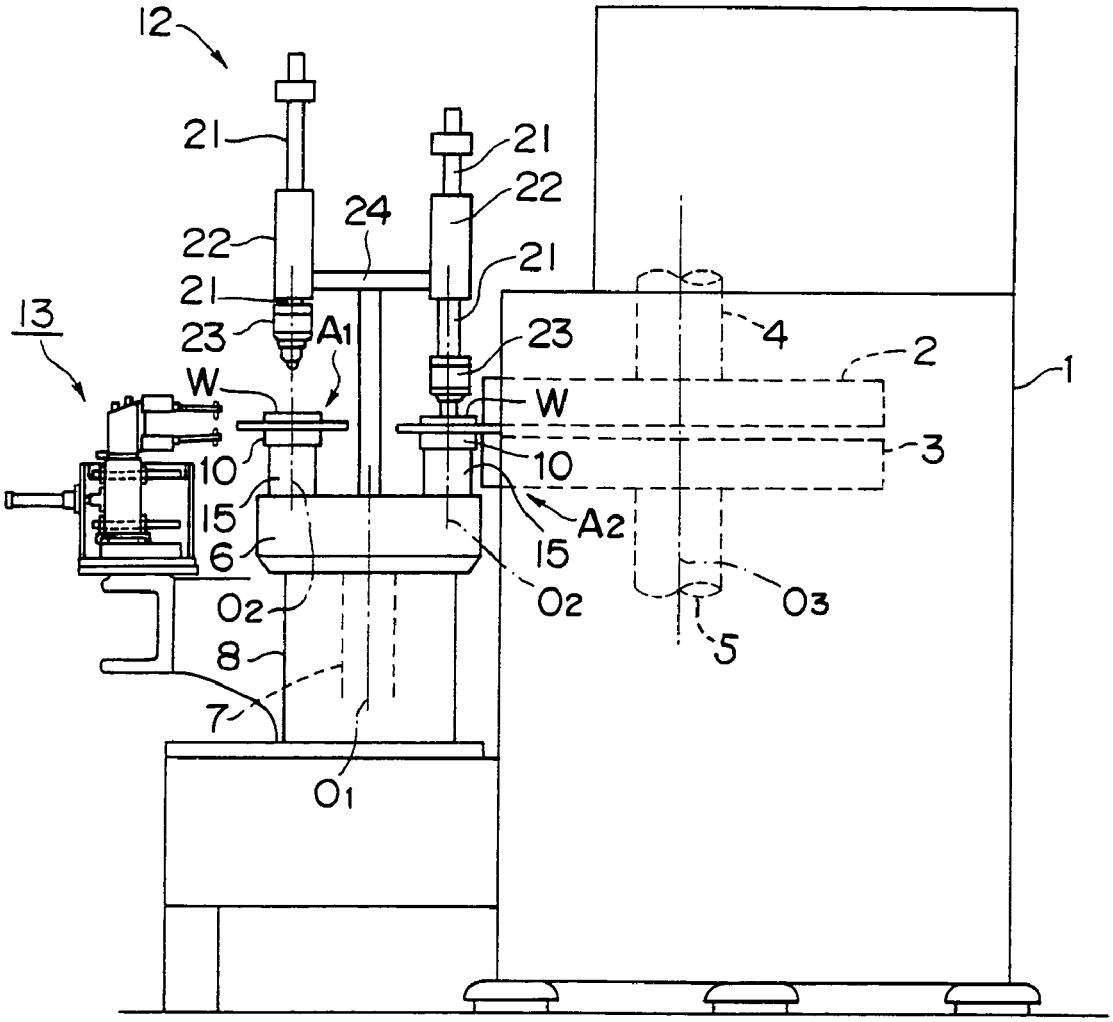
FIG. 1 is a side view of a vertical type of double disk surface grinding machine to which a grinding method according to the present invention is applied.

FIG. 1 is a side view of a vertical type of double disk surface grinding machine to which a grinding method according to the present invention is applied. In the drawing, a pair of grinding wheels 2 and 3 having an annular shape and vertically opposed to each other is housed in a body case 1, and the upper and the lower grinding wheels 2 and 3 are secured to upper and lower grinding-wheel shafts 4 and 5 disposed on the same perpendicular axis center O3. The grinding-wheel shafts 4 and 5 are respectively adapted to be vertically movable by an elevating mechanism and coupled with a power transmission mechanism in an interlocking manner so that they rotate in reverse directions relative to each other.

A rotating table 6 for moving a work is secured to an upper end of a vertical table drive shaft 7. The table drive shaft 7 is supported with respect to a cylindrical support case 8 via a bearing so as to rotate around a table rotating axis center O1 and coupled with a drive motor in an interlocking manner via a transmission mechanism not shown.

A pair of work holding jigs 10 and a clamp device 12 for fixing works W on the respective work holding jigs 10 from an upper direction are provided on the rotating table 6. A pre-grinding dimension measuring instrument 13 for measuring a dimension of the work before the grinding operation is disposed in a vicinity of the rotating table 6.

The both work holding jigs 10 are disposed with a phase difference of 180 degrees around the table rotating axis center O1 and supported with respect to cylindrical jig support cases 15 to be respectively rotated around self-rotating axis centers O2. Accordingly, positions of the work holding jigs 10 can be changed between grinding positions A2 on the grinding-wheel side and attaching/detaching positions A1 on the opposite side when the rotating table 6 is half-rotated.

The clamp device 12 is comprised of a pair of cylinders 22 each having a clamp rod 21 extensible downward and clamp units 23 mounted on lower ends of the respective clamp rods 21. The respective cylinders 22 are disposed on the same axes as the self-rotating axis centers O2 of the work holding jigs 10 and fixed to a bracket 24 fixed on an upper surface of the rotating table 6. Accordingly, the cylinders 22 rotate around the table rotating axis center O1 together with the work holding jigs 10 in response to the rotation of the rotating table 6.

Figure 2:
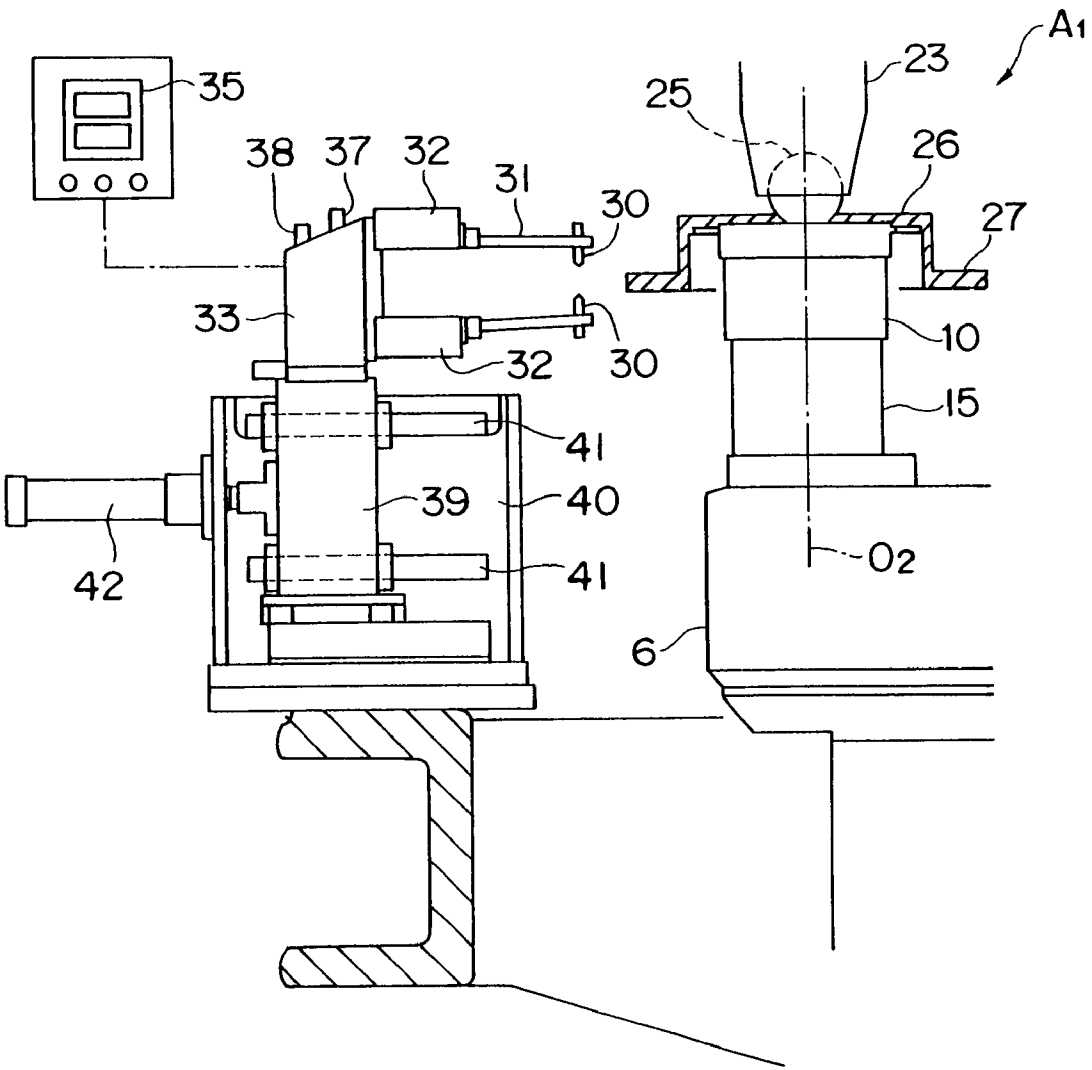
FIG. 2 is an enlarged side view of a dimension measuring instrument.

FIG. 2 shows enlarged side views of the work holding jig 10 and the measuring instrument 13 at the attaching/detaching position A1. The work W shown in a longitudinal section has an inner disk part 26 and an outer flange part 27 formed to be integral with the inner disk part 26 via a cylindrical part. Upper and lower end surfaces of the outer flange part 27 are simultaneously ground as surfaces to be ground.

The damp unit 23 of the clamp device 12 comprises a rotatable steel ball 25 at a lower end thereof and is adapted to press a periphery of a central hole in the work W using the steel ball 25 and thereby allow the holding jig 10 and the work W to rotate around the self-rotating axis center O2.

The dimension measuring instrument 13, which is disposed in a vicinity of the work attaching/detaching position A1 of the rotating table 6, is a differential transformer type electric micrometer comprising a pair of upper and lower lever-type measuring probes 30. Arm parts 31 of the measuring probes 30 are supported with respect to measuring heads 32 so as to vertically pivot. The upper arm part 31 is energized downward by an energizing means such as a plate spring, while the lower arm part 31 is energized upward by an energizing means such as a plate spring. Differential transformers for the measuring probes are incorporated in a measuring instrument main body 33 or in the measuring heads 32 and converts vertical displacements of the respective measuring probes 30 into electrical values such as current and display them on a display surface of a control board 35 via an amplifier or the like by means of a digital or pointer system. A retractor mechanism (cylinder device and the like) capable of forcibly spreading the respective measuring probes 30 upward and downward against the energizing means is provided in the respective measuring heads 32.

The upper and the lower measuring heads 32 are supported with respect to the measuring instrument main body 33 to be thereby vertically adjustable in a sliding manner and vertical positions of the measuring heads 32 can be respectively adjusted by means of an adjusting screw 37 for the upper measuring probe and an adjusting screw 38 for the lower measuring probe.

The measuring instrument main body 33 is installed in a fore/aft slider 39. The fore/aft slider 39 is supported with respect to a pair of upper and lower horizontal rails 41 provided in a perpendicular support plate 40 so as to move forward and backward. Further, the fore/aft slider 39 is coupled with a rod of a fore/aft hydraulic cylinder 42 to thereby move forward and backward in response to a telescopic motion of the hydraulic cylinder 42.

(Grinding Method)

Figure 3:
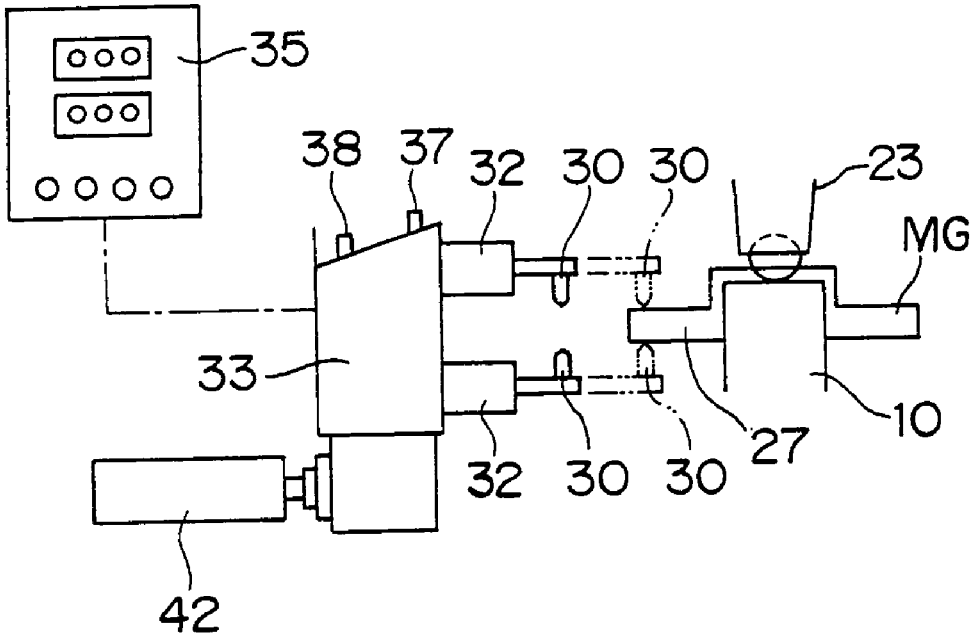
FIG. 3 is a side view of the dimension measuring instrument illustrating a 0-value adjusting operation.
Figure 4:
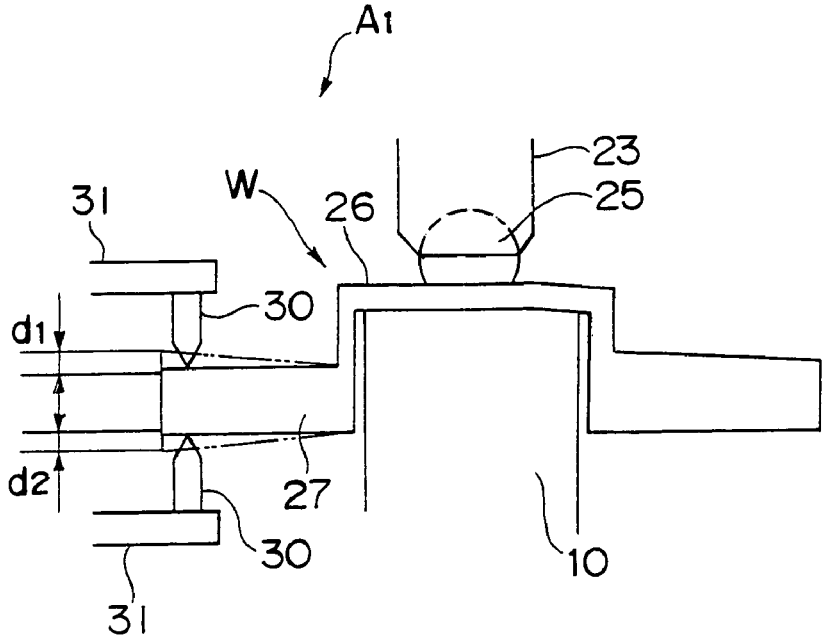
FIG. 4 is a schematic side view of an operation of measuring a dimension of a work.
Figure 5:
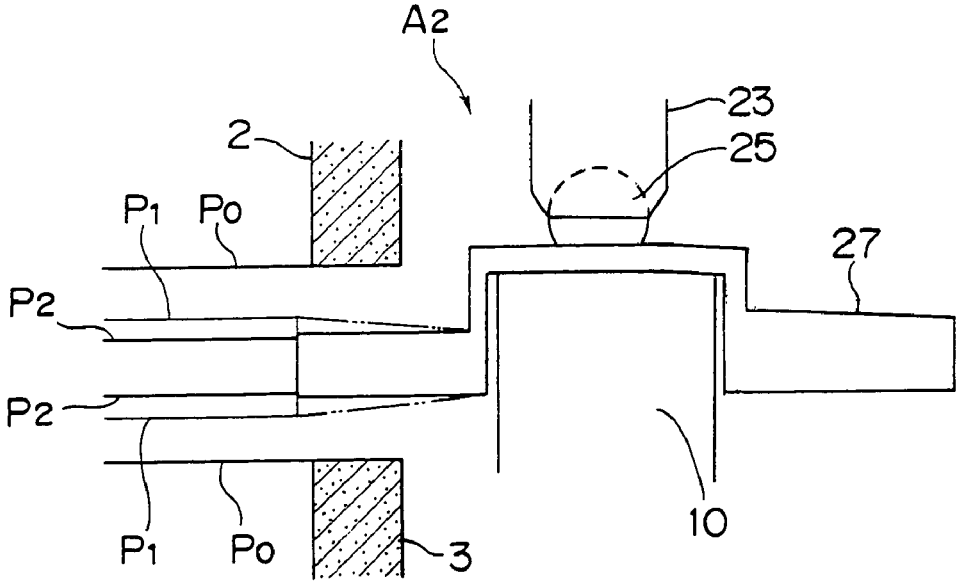
FIG. 5 is a side view of an example of a grinding operation.

First, as shown in FIG. 3, a master gauge MG serving as a standard of the dimension (thickness) of the work to be ground is used to implement a 0-value adjustment to the pre-grinding dimension measuring instrument 13. Then, the dimension of the pre-grinding work is measured at the attaching/detaching position A1 by means of the adjusted dimension measuring instrument 13 as shown in FIG. 4, and the grinding operation of a predetermined grinding allowance is carried out at the grinding position A2 based on the measured value as shown in FIG. 5. Below are described respective steps in detail.

(0-Value Adjustment of Measuring Instrument)

(1) In FIG. 3, the master gauge MG serving as the standard of the dimension of the work (thickness) to be ground is placed on an upper surface of the work holding jig 10, and a periphery of a central hole in the master gauge MG is pressed from an upper direction by means of the clamp unit 23 of the clamp device 12 so that the master gauge MG is located and fixed at a predetermined position.

(2) With the upper and the lower measuring probes 30 being spread by means of the retractor mechanism, the measuring instrument main body 33 is advanced by means of the fore/aft hydraulic cylinder 42 and the retractor mechanism is released at an advancing position shown in a phantom line. Thereby, an interval between the upper and the lower measuring probes 30 is rendered narrower, and the both measuring probes 30 are brought into contact with the upper and lower end surfaces of the outer flange part 27 of the master gauge MG.

(3) The measured current value is displayed on the display surface (monitor) of the control board 35. First, the upper measuring head 32 is vertically slid by means of the adjusting screw 37 for the upper measuring probe so that a value indicating an upper surface position is adjusted to "0", and next, the lower measuring head 32 is vertically slid by means of the adjusting screw 38 for the lower measuring probe so that a value indicating a lower surface position is adjusted to "0".

(4) The vertical retraction of the measuring arm part 31 is repeated to confirm that the displayed values do not largely change. After the confirmation, the measuring instrument main body 33 is retreated with the measuring probes 30 being vertically expanded by means of the retractor, the clamp by the clamping device 12 is released, and the master gauge MG is removed from the work holding jig 10.

(Measurement of Work in Pre-Grinding State)

(1) In FIG. 2, the unground work W (pre-grinding state) is placed on the work holding jib 10 at the work attaching/detaching position A1 by means of a loading device not shown, and located and fixed with respect to the work holding jig 10 by pressing the periphery of the central hole in the work W using the clamp unit 23 of the clamp device 12.

(2) After the work W is located and fixed with respect to the work holding jig 10 as described above, vertical positions of the upper and lower end surfaces of the flange part 27 are measured by means of the measuring instrument 13 while the work W is being slowly self-rotated.

More specifically, the measuring instrument main body 33 is advanced with the measuring probes 30 being vertically spread, and the lower measuring probe 30 is elevated as soon as the upper measuring probe 30 is descended relative to the slowly rotating work W so that vertical positions of the upper and the lower surfaces of the unground work W to be ground are measured.

In FIG. 4, a vibratory movement may be vertically generated during one rotation of the work 1 depending on the pre-grinding precision, as shown in a phantom line. Maximum values d1 and d2 of the standard values subjected to the 0-value adjustment are respectively inputted to a control device in the control board 35, and the standby positions of the grinding wheels are set based on the inputted values d1 and d2 so that the respective approach amounts relative to the work W is minimized. More specifically, the standby positions of the grinding wheels are set so that respective required minimal approach amounts (for example, a few hundreds of $\mu$m) can be assured from the maximum values d1 and d2 of the upper and the lower surfaces of the measured work to be ground.

(Grinding Operation)

(1) In FIG. 5, the upper and the lower grinding wheels 2 and 3 are retreated upward and downward to standby positions P0 figured out per work based on the pre-grinding dimension as described and put on standby.

(2) The work W at the attaching/detaching position A1 is moved to the grinding position A2 in response to the rotation of the rotating table 6 shown in FIG. 1 and the work holding jig 10 is self-rotated so that the work W is rotated around the self-rotating axis center O2.

(3) In FIG. 5, as soon as the upper grinding wheel 2 is descended at a high feeding speed from the standby position P0, the lower grinding wheel 3 is elevated at the same speed. The both grinding wheels 2 and 3 are fed to the grinding start positions P1 by the predetermined approach amount. Thereafter, the elevating and descending speed of the upper and the lower grinding wheels 2 and 3 is changed to a lower grinding speed, and the grinding of the predetermined grinding allowance is carried out to grinding end positions.

OTHER EMBODIMENTS OF THE INVENTION (1) The grinding steps after the approach at the high feeding speed can be variously modified depending on a material used. For example, the grinding can be carried out in such manner that the speed is gradually lowered from a rough grinding speed to a finishing grinding speed.

(2) As the moving table for changing the position of the work from the attaching/detaching position to the grinding position, a moving table of a linear type, other than the rotating table, can be also used.

What is claimed is:

1. A grinding method for a vertical type of double disk surface grinding machine comprising: a pair of rotating grinding wheels vertically opposed to each other and vertically movable; a moving table for moving a work having a work holding jig, wherein a position of the work can be changed by the moving table to and from a grinding position and to and from a work attaching/detaching position, wherein at the grinding position, both grinding wheels are moved from standby positions to grinding positions so that the upper and the lower surfaces of the work are simultaneously ground, said method comprising:

in a first step, measuring vertical positions of the upper and the lower surfaces of the work to be ground prior to a grinding operation by means of a pre-grinding dimension measuring instrument which are disposed in a vicinity of the work attaching/detaching position, wherein the standby positions of the grinding wheels are set based on the pre-grinding measured values;

in a subsequent step, moving the work to the grinding position and the moving grinding wheels at a high feeding speed from the set standby positions to one of grinding start positions in contact with the work or start positions immediately before making contact with the work; and in a further subsequent step grinding the work at a grinding speed lower than the feeding speed.

2. A grinding method as claimed in claim 1, characterized in that the pre-grinding dimension measuring instrument is a differential transformer type electric micrometer comprising a pair of upper and lower lever-type measuring probes, wherein a pre-grinding dimension of the work is measured by vertically holding the work using the measuring probes.

3. A grinding method as claimed in claim 2, wherein arm parts of the respective measuring probes are supported with respect to measuring heads so as to vertically pivot, and the upper arm part is energized downward by a spring means.

* * * * *